US010968022B2

(12) United States Patent
Bangi et al.

(10) Patent No.: US 10,968,022 B2
(45) Date of Patent: Apr. 6, 2021

(54) HOT-FILL CONTAINER HAVING VACUUM ABSORPTION SECTIONS

(71) Applicant: ALPLA Werke Alwin Lehner GmbH & Co. KG, Hard (AT)

(72) Inventors: Monis Bangi, Mcdonough, GA (US); Lesley Corker, Atlanta, GA (US)

(73) Assignee: ALPLA Werke Alwin Lehner GmbH & Co. KG

( * ) Notice: Subject to any disclaimer, the term of this patent is extended or adjusted under 35 U.S.C. 154(b) by 0 days.

(21) Appl. No.: 16/304,271

(22) PCT Filed: May 22, 2017

(86) PCT No.: PCT/IB2017/001464
§ 371 (c)(1),
(2) Date: Nov. 23, 2018

(87) PCT Pub. No.: WO2018/037287
PCT Pub. Date: Mar. 1, 2018

(65) Prior Publication Data

US 2019/0084747 A1 Mar. 21, 2019

Related U.S. Application Data

(63) Continuation of application No. 15/417,359, filed on Jan. 27, 2017, now Pat. No. 10,850,905.
(Continued)

(51) Int. Cl.
*B65D 1/40* (2006.01)
*B65D 79/00* (2006.01)
(Continued)

(52) U.S. Cl.
CPC ..... *B65D 79/005* (2013.01); *B65D 1/0223* (2013.01); *B65D 1/0246* (2013.01);
(Continued)

(58) Field of Classification Search
CPC ..... B65D 79/005; B65D 79/0084
(Continued)

(56) References Cited

U.S. PATENT DOCUMENTS 5,067,622 A * 11/1991 Garver ..... B29C 49/64 215/381
5,704,503 A 1/1998 Krishnakumar
(Continued)

*Primary Examiner* — Allan D Stevens
(74) *Attorney, Agent, or Firm* — Morriss O'Bryant Compagni Cannon, PLLC

(57) ABSTRACT

The present disclosure describes a hot-fill container for use with a hot-filling process. The container includes vacuum absorption sections that resist partial collapse and uncontrolled deformation of the container's walls during the hot-filling process. The vacuum absorption sections are asymmetrically-formed and include respective edge portions and panel portions configured to deform and pivot about a linear part of the edge portions when a vacuum is created inside the container. The edge portions have a curvilinear part that is adapted to comfortably receive and engage a user's fingers during use of the container, making the container more user friendly. The vacuum absorption sections are arranged about the container's central longitudinal axis such that their respective panel portions substantially form the sides of a polygon when viewed in top plan view. The polygon appears to be inscribed within an otherwise circular container periphery.

8 Claims, 9 Drawing Sheets

Related U.S. Application Data

(60) Provisional application No. 62/340,438, filed on May 23, 2016.

(51) Int. Cl.
*B65D 1/02* (2006.01)
*B65D 1/46* (2006.01)
*B65D 41/04* (2006.01)

(52) U.S. Cl.
CPC ..... *B65D 1/0276* (2013.01); *B65D 1/46* (2013.01); *B65D 41/04* (2013.01); *B65D 79/0084* (2020.05)

(58) Field of Classification Search
USPC ..... 215/381
See application file for complete search history.

(56) References Cited

U.S. PATENT DOCUMENTS 6,036,037 A * 3/2000 Scheffer ..... B65D 1/0223 215/381
6,044,997 A 4/2000 Ogg
D445,693 S * 7/2001 Rashid ..... D9/538
D445,694 S * 7/2001 Gans ..... D9/538
6,257,433 B1 7/2001 Ogg et al.
D446,458 S * 8/2001 Gans ..... D9/538
6,273,282 B1 8/2001 Ogg et al.
6,513,669 B2 2/2003 Ozawa et al.
7,178,684 B1 * 2/2007 Budden ..... B65D 1/0223 215/381
7,347,339 B2 3/2008 Bangi
2002/0000421 A1 * 1/2002 Ota ..... B65D 1/0223 215/381
2006/0131257 A1 6/2006 Gatewood
2006/0273064 A1 12/2006 Haley
2008/0041812 A1 2/2008 Stowitts
2008/0105645 A1 5/2008 Boukobza
2008/0190884 A1 8/2008 Harris
2009/0014407 A1 * 1/2009 Strasser ..... B65D 1/0223 215/381
2010/0116778 A1 5/2010 Melrose
2011/0204070 A1 * 8/2011 Pedmo ..... B65D 1/0223 220/673
2012/0187069 A1 7/2012 Harris
2016/0236845 A1 8/2016 Boukobza
2017/0334628 A1 11/2017 Bangi

* cited by examiner

HOT-FILL CONTAINER HAVING VACUUM ABSORPTION SECTIONS

This application is a national phase entry under 35 U.S.C. § 371 of PCT/162017/001464 filed on May 22, 2017, which claims priority to U.S. Provisional Patent Application No. 62/340,438, filed May 23, 2016, and U.S. patent application Ser. No. 15/417,359, filed Jan. 27, 2017, the disclosures of which are hereby incorporated by reference herein in their entirety.

FIELD OF THE INVENTION

The present invention relates, generally, to the field of containers, and to, more particularly, containers for use with hot-fill processes.

BACKGROUND OF THE INVENTION

Today, many beverages are delivered to consumers in containers that are filled with the beverages via a hot-fill process. In a typical hot-fill process, the beverage is pasteurized and heated up to a hot-fill temperature in the range of 190° F. to 203° F. in a heat exchanger for at least 15 to 30 seconds in order to kill any microorganisms present in the beverage. The beverage is then cooled to a temperature in the range of 180° F. to 185° F. immediately prior to filling of the containers. After filling, the containers are closed with respective closures and are tilted over onto their sides before immersion in a cooling bath or spraying with cooling water, thereby exposing the internal structure of the closures to the beverage and sterilizing the closures. By virtue of the heating and cooling of the beverage prior to filling and tilting of the containers, the beverage, containers and closures are all sterilized. Cooling of the containers and beverage helps preserve the beverage's taste and nutritional properties. The cooling of the containers and beverage also creates a vacuum inside the containers, further preventing microbial growth.

Advantageously, due to the sterilization, hot-filling is a good option for many fruit and vegetable juices, enhanced water, and tea beverages as the process eliminates the need to add preservatives and provides an ambient temperature shelf life for the beverage of 6 to 12 months. Additionally, hot-fill compatible containers (also referred to herein as "hot-fill containers") are readily available in a number of relatively inexpensive plastic materials such as, but not limited to, polyethylene terephthalate (PET).

Unfortunately, the vacuum created inside the containers during cooling of the containers and beverage produces a pressure differential across the containers' walls which can cause "paneling"—partial collapse of the containers' walls in an inward direction. The partial collapse of the containers' walls can leave the containers permanently deformed and distorted from their original shape. Such deformation and distortion may make the containers aesthetically unappealing and can render the subsequent application of labels to the containers difficult, if not impossible.

There is, therefore, a need in the industry for a container compatible for use in hot-fill processes which resists or eliminates paneling and which solves other related or unrelated problems, difficulties, or shortcomings of present hot-fill containers.

SUMMARY OF THE INVENTION

Broadly described, the present invention comprises a hot-fill container for use with a hot-filling process having at least one vacuum absorption section that resists partial collapse and uncontrolled deformation of the container's walls during the hot-filling process. According to an example embodiment, the hot-fill container comprises a body portion having at least one vacuum absorption section formed asymmetrically therein and having a periphery configured generally in the shape of the English alphabet capital letter "D". With part of the vacuum absorption section and part of the surrounding body portion joining along a linear part of the edge portion of the vacuum absorption section to create a pivot axis, the vacuum absorption section deforms controllably through rotation relative to the body portion about the pivot axis during hot-filling of the hot-fill container.

Also, according the example embodiment, the hot-fill container further comprises a finish and a base portion with the at least one vacuum absorption section being located in the container's body portion intermediate the finish and base portion at a location where a user's fingers naturally grasp the container. Due at least in part to the periphery of the vacuum absorption section being configured generally in the shape of the English alphabet capital letter "D", the pulp portions of a user's fingertips comfortably engage and fit within the curved part of the vacuum absorption section, thereby making grasping of the hot-fill container more ergonometric and sure.

Additionally, according to the example embodiment, the hot-fill container further comprises other similar vacuum absorption sections such that the plurality of vacuum absorption sections are arranged at respective angular locations about the container's central longitudinal axis and protrude into an internal cavity defined by the hot-fill container. Together, the vacuum absorption sections are arranged such that the container's wall has a substantially polygonal cross-sectional shape in the vicinity of the vacuum absorption sections as opposed to the otherwise generally circular cross-sectional shape of the hot-fill container's wall at each location along the central longitudinal axis not in the vicinity of the vacuum absorption sections. The vacuum absorption sections are also configured such that adjacent vacuum absorption sections define columns therebetween, providing enhanced structural strength and rigidity.

Other uses, advantages and benefits of the present invention may become apparent upon reading and understanding the present specification when taken in conjunction with the appended drawings.

DETAILED DESCRIPTION OF AN EXAMPLE EMBODIMENT

Figure 1:
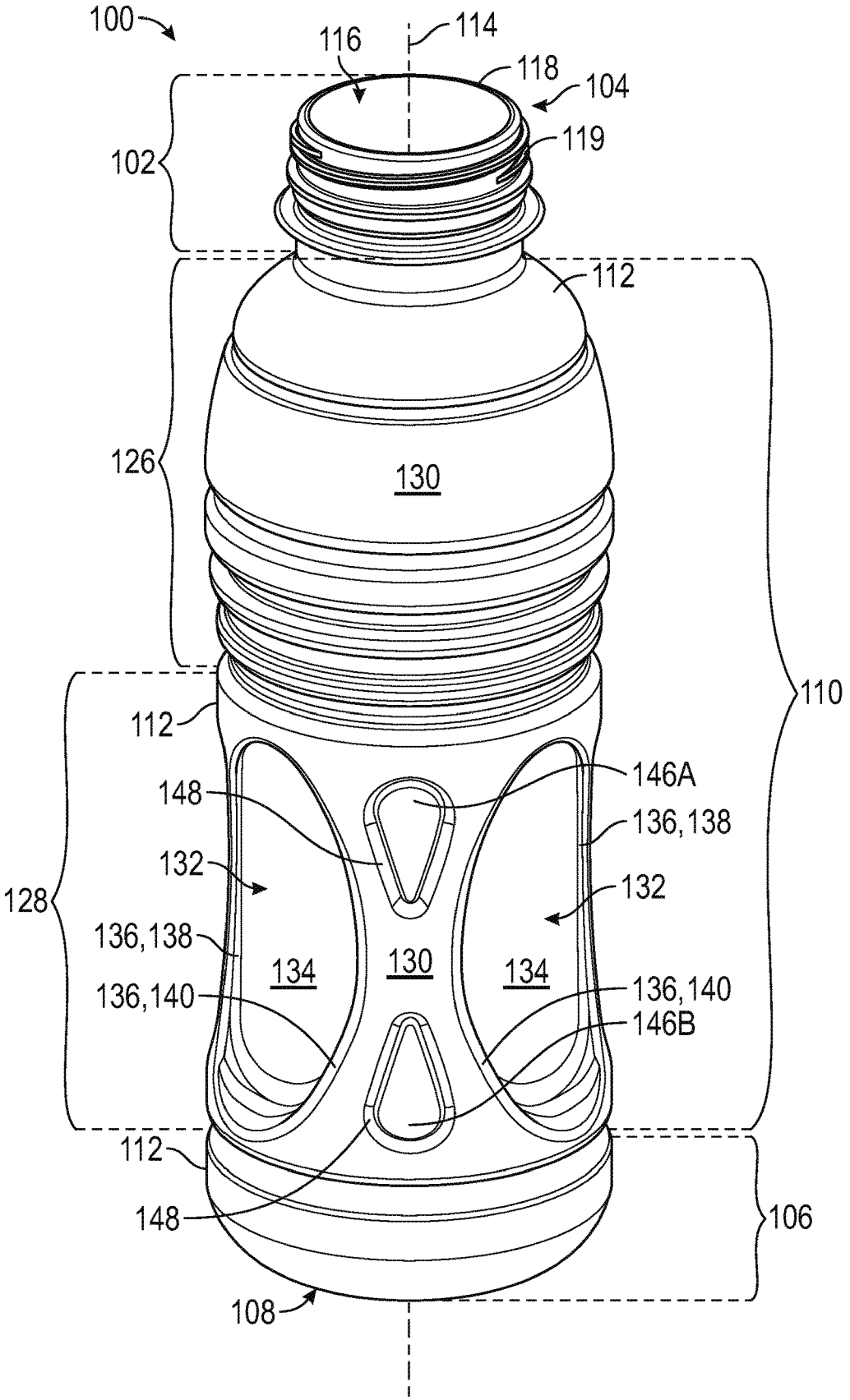
FIG. 1 displays a perspective view of a hot-fill container in accordance with an example embodiment of the present invention.

Referring now to the drawings in which like numerals represent like elements or steps throughout the several views, FIG. 1 displays a hot-fill container 100, according to an example embodiment of the present invention, for use in hot-fill processes or operations in which pre-heated content is injected into the hot-fill container 100. Such content is generally in a flowing form (including, without limitation, in a liquid form, a semi-liquid form, or other form) and frequently constitutes a food or beverage for future consumption by a person or animal. After injection of the content into the hot-fill container 100, a closure or cap (not shown) is secured to the hot-fill container 100 to retain the content.

The hot-fill container 100 (also sometimes referred to herein as the "container 100") comprises, according to the example embodiment, a finish portion 102 located at a first end 104 of the container 100, a base portion 106 located at a distant second end 108 of the container 100, and a body portion 110 located intermediate the finish portion 102. The finish portion 102, base portion 106, and body portion 110 are formed by a single wall 112 extending between the container's first and second ends 104, 108 and about a central longitudinal axis 114 of the container 100. The wall 112 (and, hence, the container 100) defines a cavity 116 for receiving and holding the content injected into the container 100 during a hot-fill process. The wall 112 is generally formed from a polyethylene terephthalate (PET) material using a blow-molding process. It should, however, be understood and appreciated that the wall 112 (and, therefore, the container 100) may be manufactured from other materials and through the use of other processes appropriate for polyethylene terephthalate (PET) or such other materials.

Figure 6:
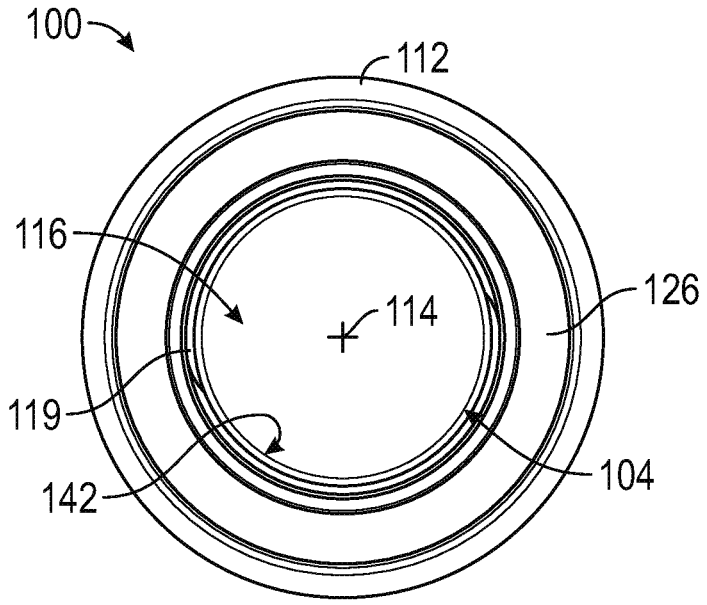
FIG. 6 displays a top plan view of the hot-fill container of FIG. 1.

The finish portion 102 (also referred to herein as the "finish 102") of the container 100 defines an opening 118 at the container's first end 104 that is in fluid communication with the cavity 116 (see FIGS. 1 and 6). Contents are injected through the opening 118 and into the cavity 116 when the container 110 is filled during a hot-fill process. The finish 102 is configured with a plurality of threads 119 that are adapted to threadedly receive and engage a closure or cap (not shown) in order to retain the contents within the container 100.

Figure 7:
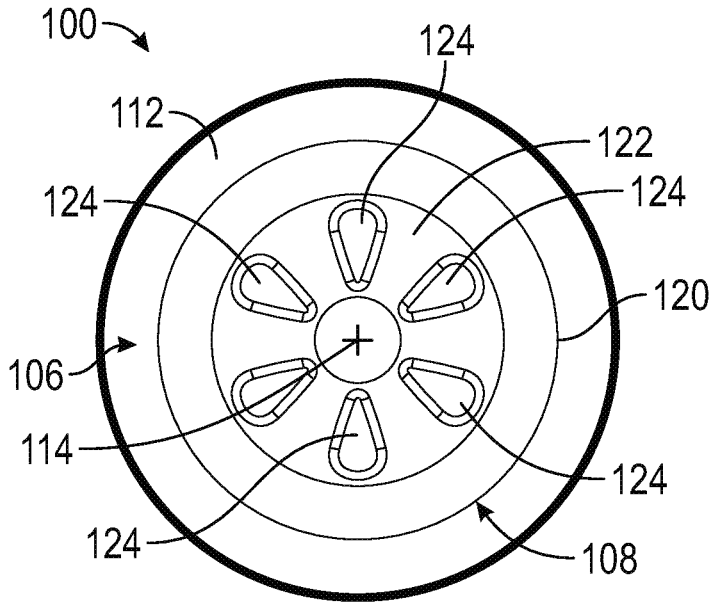
FIG. 7 displays a bottom plan view of the hot-fill container of FIG. 1.

The base portion 106 of the container 100 is configured to rest on a generally planar surface and support the remainder of the container 100 and contents (if any) in an upright orientation without tipping or leaning of the container 100. The base portion 106, seen more clearly in the bottom plan view of FIG. 7, includes a ridge 120 extending at a radius about the container's central longitudinal axis 114 and forming a circle about the central longitudinal axis 114. The ridge 120 is adapted to engage a surface on which the container 100 resides and, at least in part due to its circular shape, provide substantial stability and tip resistance in all lateral directions relative to central longitudinal axis 114.

The base portion 106 also includes a concave dome portion 122 extending about central longitudinal axis 114 and inwardly toward the container's first end 104. The concave dome portion 122 flexes outward away from the container's first end 104 and allows the container's base portion 106 to compensate for pressure within the container 100 created during hot-filling of the container 100, thereby avoiding other deformation of the base portion 106 and ridge 120 that might render the container 100 unstable and more prone to tipping over. The concave dome portion 122 has a plurality of recesses 124 formed therein and protruding into the cavity 116 that are arranged at various angular locations about the container's central longitudinal axis 114. The recesses 124 have a generally teardrop shape with the smaller end of the teardrop nearest central longitudinal axis 114 and with the recesses 124 extending radially away from the central longitudinal axis 114. The recesses 124 enhance the structural rigidity of the container 100 and further enable the base portion 106 to compensate for pressure within the container 100 created during hot-filling of the container 100.

The container's body portion 110, as seen in FIGS. 1-5, has a bulbous portion 126 nearest the finish 102 and a label portion 128 disposed between the bulbous portion 126 and the base portion 106. The label portion 128 is adapted to receive a product packaging label secured on or to the container wall's outer surface 130 and is also configured, sized, and shaped to define a generally hourglass shape (or generally concave shape relative to the container's central longitudinal axis 114) that is aesthetically pleasing to many users. The hourglass shape also provides a haptic, ergonometric feel to a user of the container 100 and makes grasping and holding of the container 100 easier and more comfortable (see FIG. 8). The hourglass or concave shape results from the container wall's outer surface 130 having a radius, "R".

The label portion 128 of container's body portion 110 comprises a plurality of vacuum absorption sections 132 formed in the wall 112 at respective angular locations about the container's central longitudinal axis 114 and around the label portion's periphery. The vacuum absorption sections 132 are configured to compensate for the vacuum produced within the container 100 during the hot-fill process by deforming in a controlled, pre-planned manner relative to the remainder of the container 100. Each vacuum absorption section 132 is asymmetrically formed relative to the direction of the central longitudinal axis 114, comprises a portion of the container's wall 112, and protrudes into the container's cavity 116 relative to the surrounding portion of the wall 112 such that each vacuum absorption section 132 defines a recess in the outer surface 130 of the wall 112.

Figure 2:
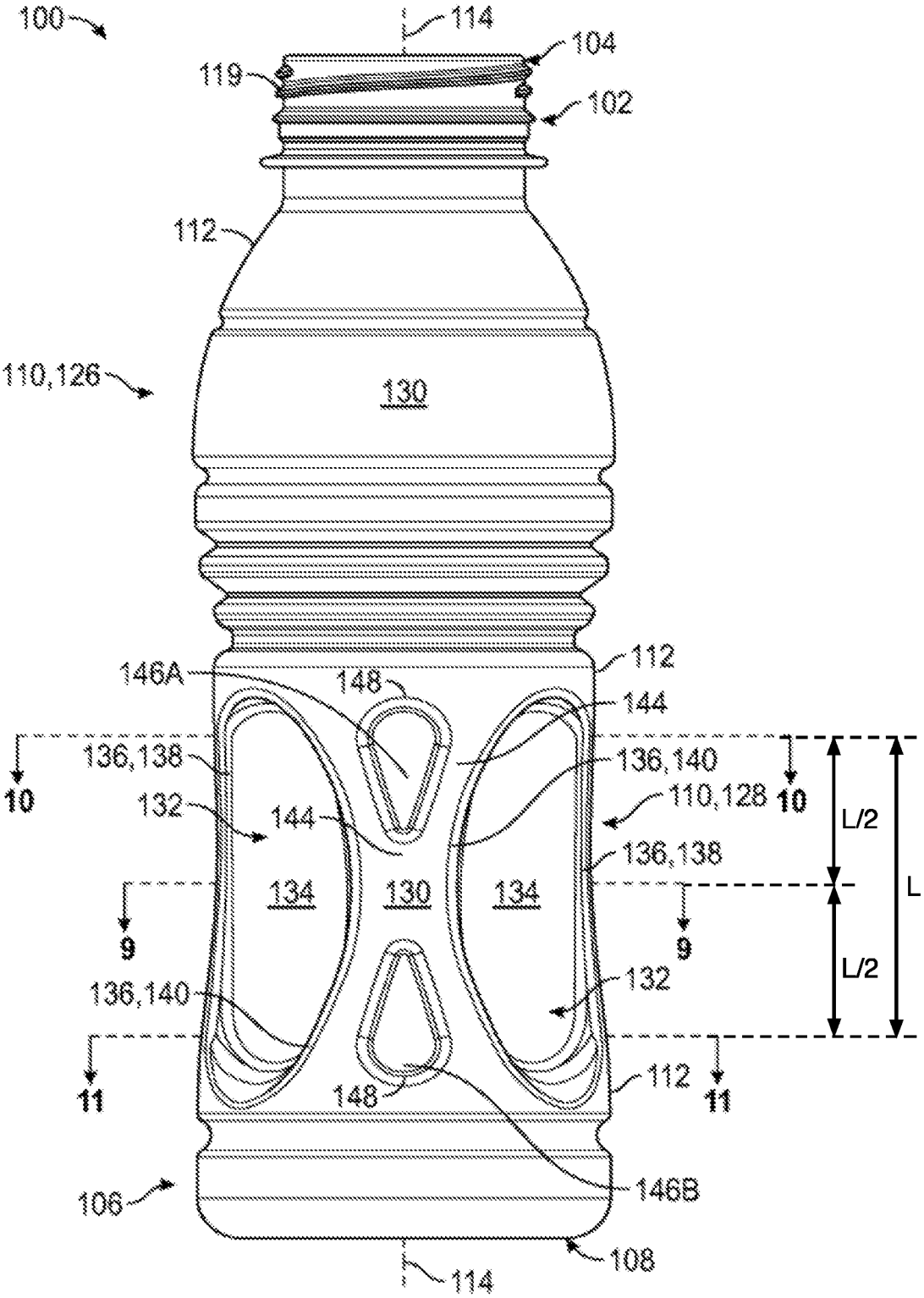
FIG. 2 displays a front, elevation view of the hot-fill container of FIG. 1.
Figure 3:
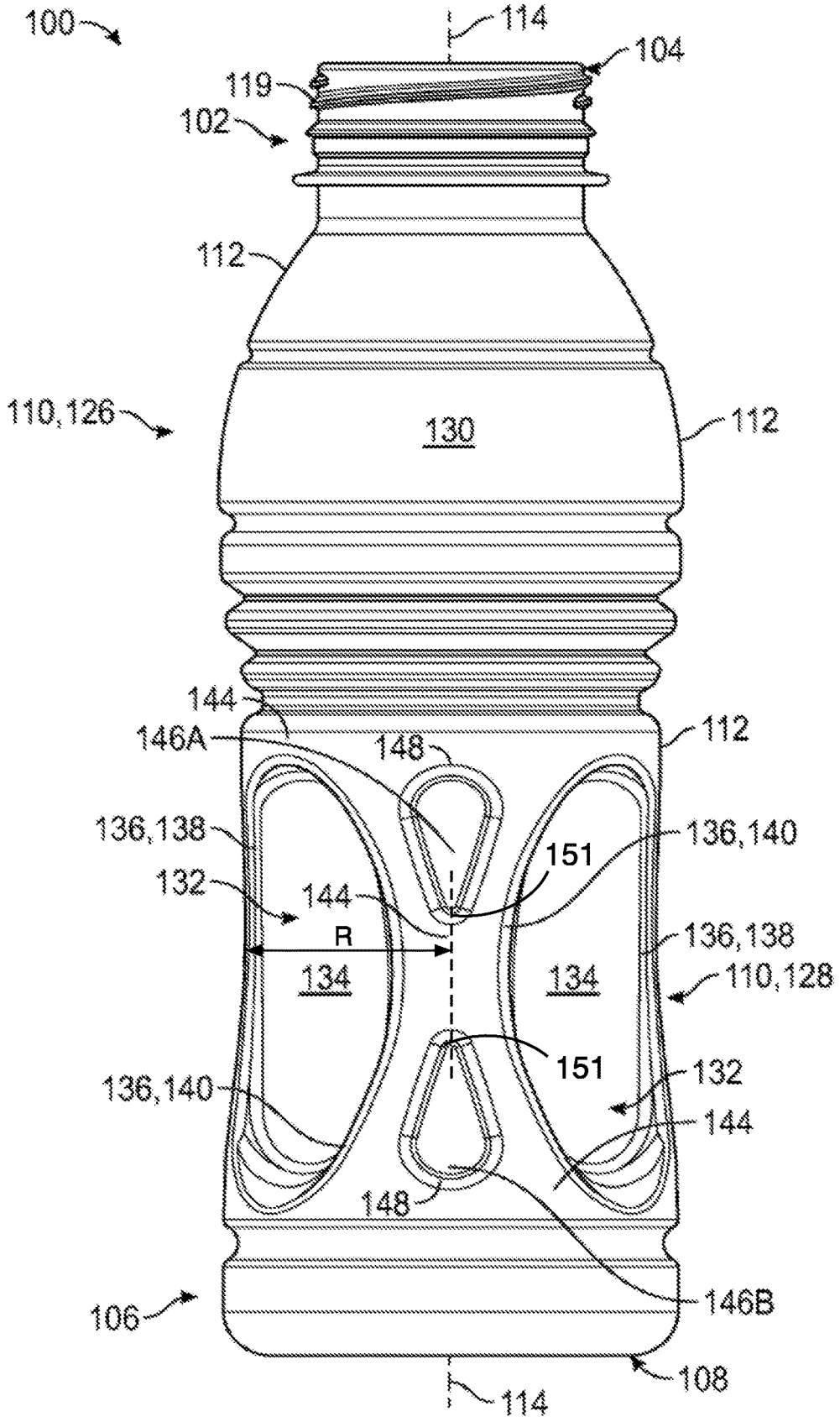
FIG. 3 displays a back, elevation view of the hot-fill container of FIG. 1.
Figure 4:
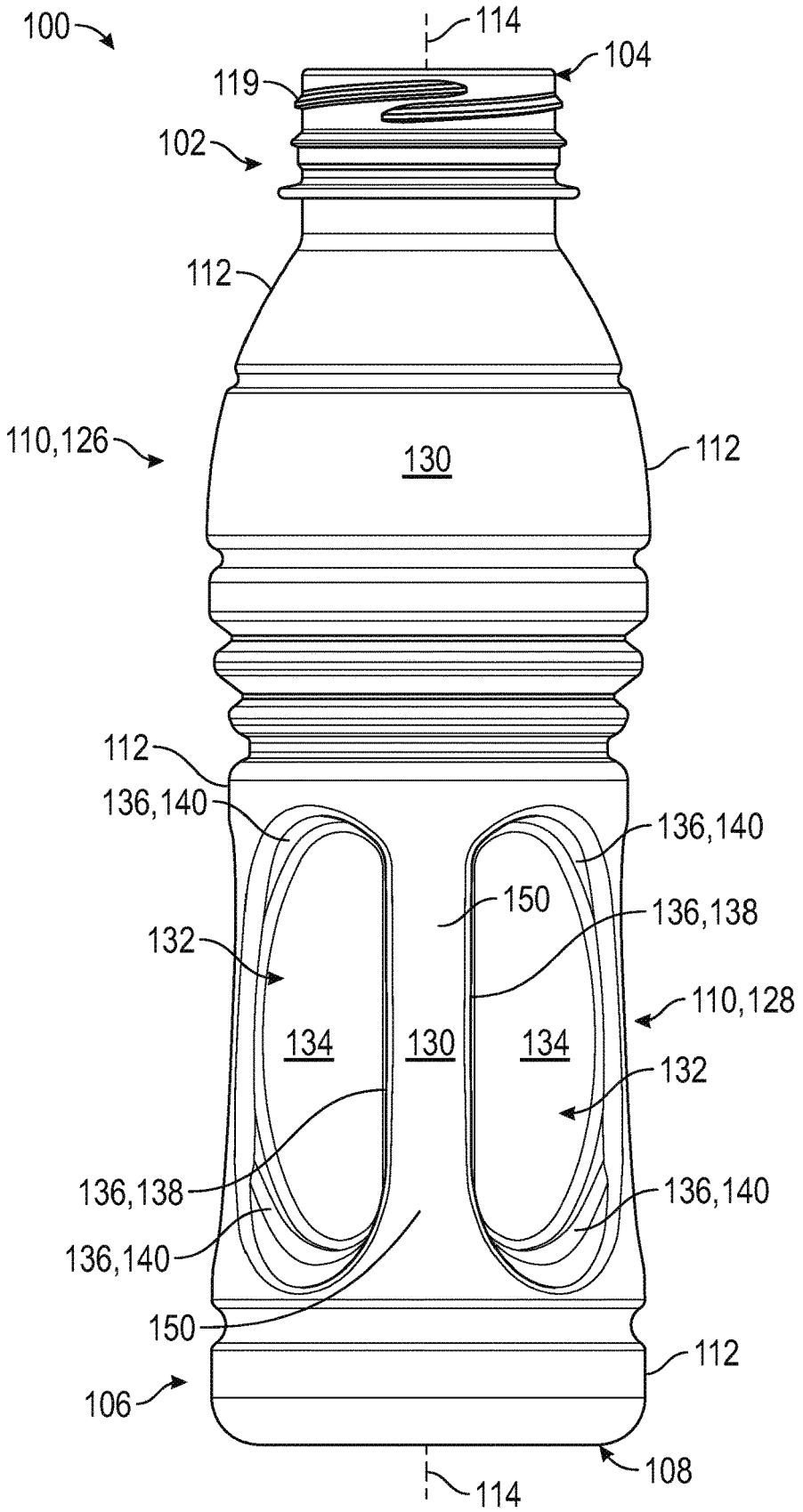
FIG. 4 displays a right side, elevation view of the hot-fill container of FIG. 1.
Figure 5:
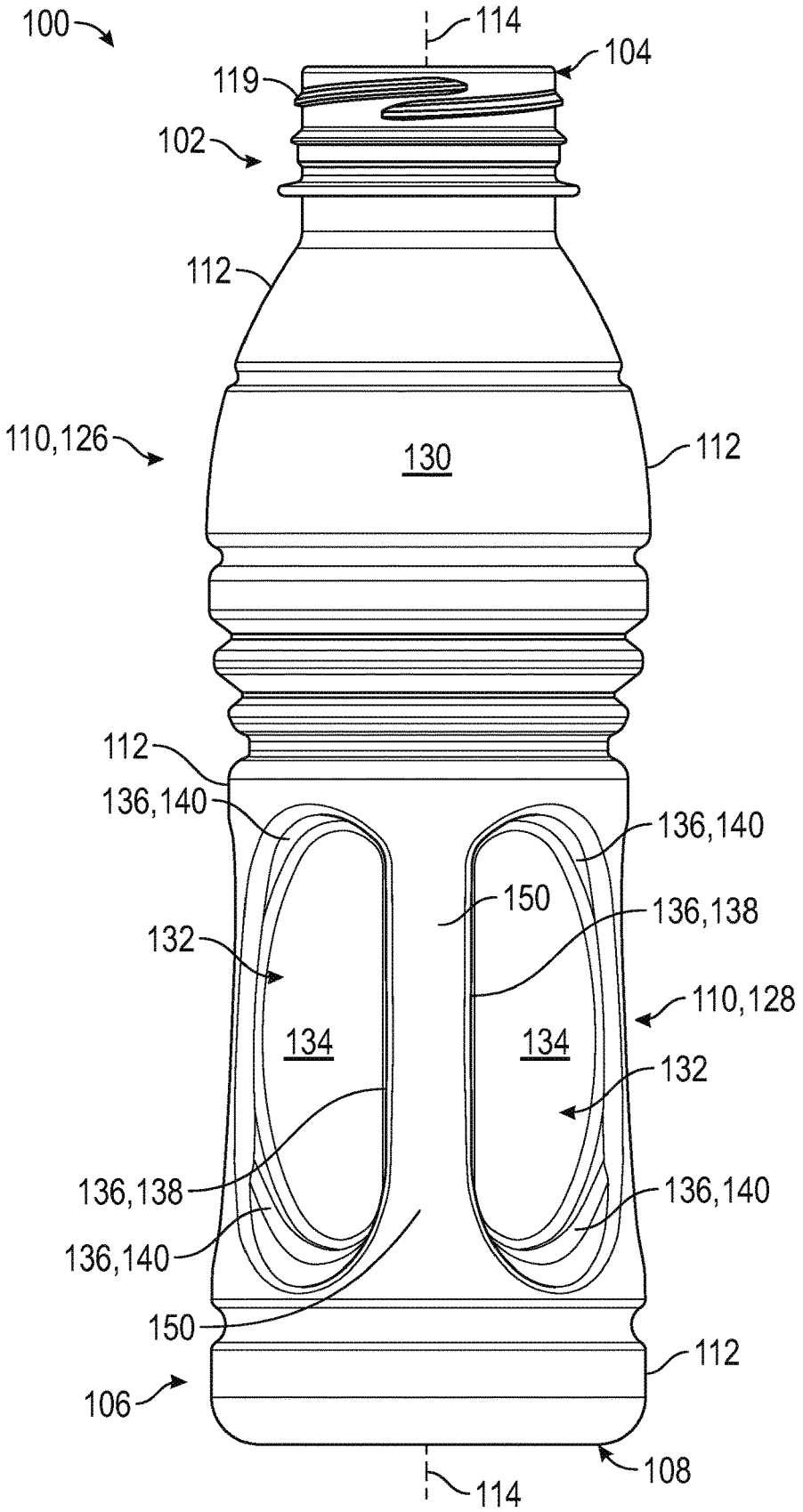
FIG. 5 displays a left side, elevation view of the hot-fill container of FIG. 1.

According to the example embodiment and as seen in the front and back views of FIGS. 2 and 3 and the right and left side views of FIGS. 4 and 5, each vacuum absorption section 132 has a panel portion 134 that is substantially planar and an edge portion 136 extending around the perimeter of the panel portion 134 and joining the panel portion 134 to the surrounding portion of the container's wall 112. The panel portion 134 recessed relative to the remainder of the container's wall 112. The edge portion 136 defines the extent of the panel portion 134 and has a substantially linear part 138 and a curvilinear part 140. In cross-section perpendicular to the container's central longitudinal axis 114, the substantially linear part 138 has a, generally, "S"-shape, whereas the curvilinear part 140 fades and blends gradually into the surrounding portion of the container's wall 112. Together, the linear and curvilinear parts 138, 140 form an asymmetric shape substantially similar to the English capital alphabet letter "D", thereby causing the panel portion 134 and vacuum absorption section 132, as a whole, to have the same shape as the edge portion 136. The panel portions 134 of the vacuum absorption sections 132 are adapted to compensate for the pressure differential between the inside and outside of the container 100 that arises when the container 100 is cooled from around 185 degrees Fahrenheit (185° F.) to 75 degrees Fahrenheit (75° F.) during a hot-fill process. According to the example embodiment, the panel portions 134 are configured in size, shape and structure to together compensate for up to a three percent (3%) reduction in the container's volume resulting from hot-filling. Thus, the surface area of each panel portion 134 is selected based, at least in part, on the pressure differential and container volume reduction created by hot-filling, on the number of vacuum absorption sections 132 present in container's wall 112 in a particular embodiment, and on the material and thickness of the material used for the container 100.

Figure 12:
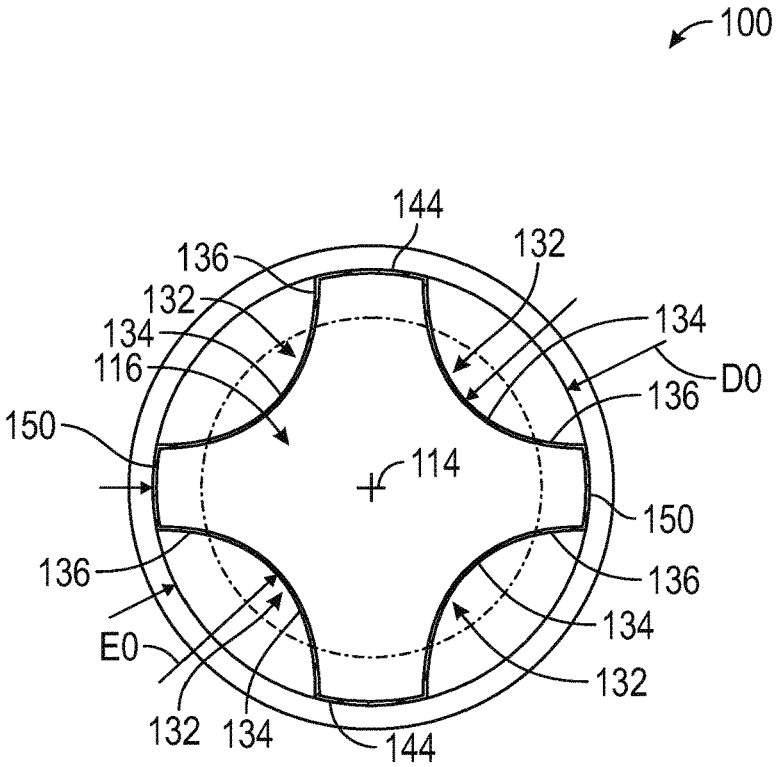
FIG. 12 displays a cross-sectional view of the hot-fill container of FIG. 2, taken along section line 9-9, in a deformed state.

When a vacuum is created within the container 100 during a hot-fill process, a vacuum is created within the container's cavity 116 and the pressure differential between the wall's outer surface 130 and the wall's inner surface 142 causes the application of a force to the panel portion 134 of each vacuum absorption section 132 tending to push the panel portion 134 into the container's cavity 116. In turn, each vacuum absorption section 132 deforms in response to the applied force by rotating, or pivoting, of its panel portion 134 about the linear part 138 of the edge portion 136. Thus, during such deformation, the linear part 138 of the edge portion 136 acts as a rotation or pivot axis for the panel portion 134 of the vacuum absorption section 132 and allows the panel portion 134 to take on an arcuate shape (see FIG. 12). To do so, the linear part's cross-sectional "S"-shape straightens out such that the cross-sectional "S"-shape becomes more planar-like. By acting as a rotation or pivot axis, deformation of the vacuum absorption 132 occurs more readily and in a controlled, pre-determined manner without damaging other parts of the container 100.

The vacuum absorption sections 132 are arranged, according to the example embodiment, about the container's central longitudinal axis 114 with their edge portion's linear and curvilinear parts 138, 140 oriented such that the curvilinear part 140 of each section's edge portion 136 is angularly adjacent about the central longitudinal axis 114 to the curvilinear part 140 of another section's edge portion 136. In such arrangement, the container's wall 112 extends between the angularly adjacent vacuum absorption sections 132 and forms an hourglass-shaped column 144 therebetween (see FIGS. 1, 2 and 3). The container's wall 112 defines, in each hourglass-shaped column 144, multiple stiffeners 146A and 146B with a first stiffener 146A being formed in the wall 112 elevationally above a second stiffener 146B. Each stiffener 146A and 146B has an edge 148 extending thereabout with each edge 148 defining, according to the example embodiment, a teardrop shape. The stiffeners 146A and 146B are oriented such that the tapered (or smaller) ends 151 of the stiffeners 146A and 146B are nearest one another. Each stiffener 146 protrudes slightly into the container's cavity 116 relative to the surrounding portion of the wall 112 such that each stiffener 146 defines a slight recess in the wall's outer surface 130. According to the example embodiment, each stiffener 146A and 146B protrudes less into the container's cavity 116 than the panel portion 134 of each vacuum absorption section 132.

Figure 8:
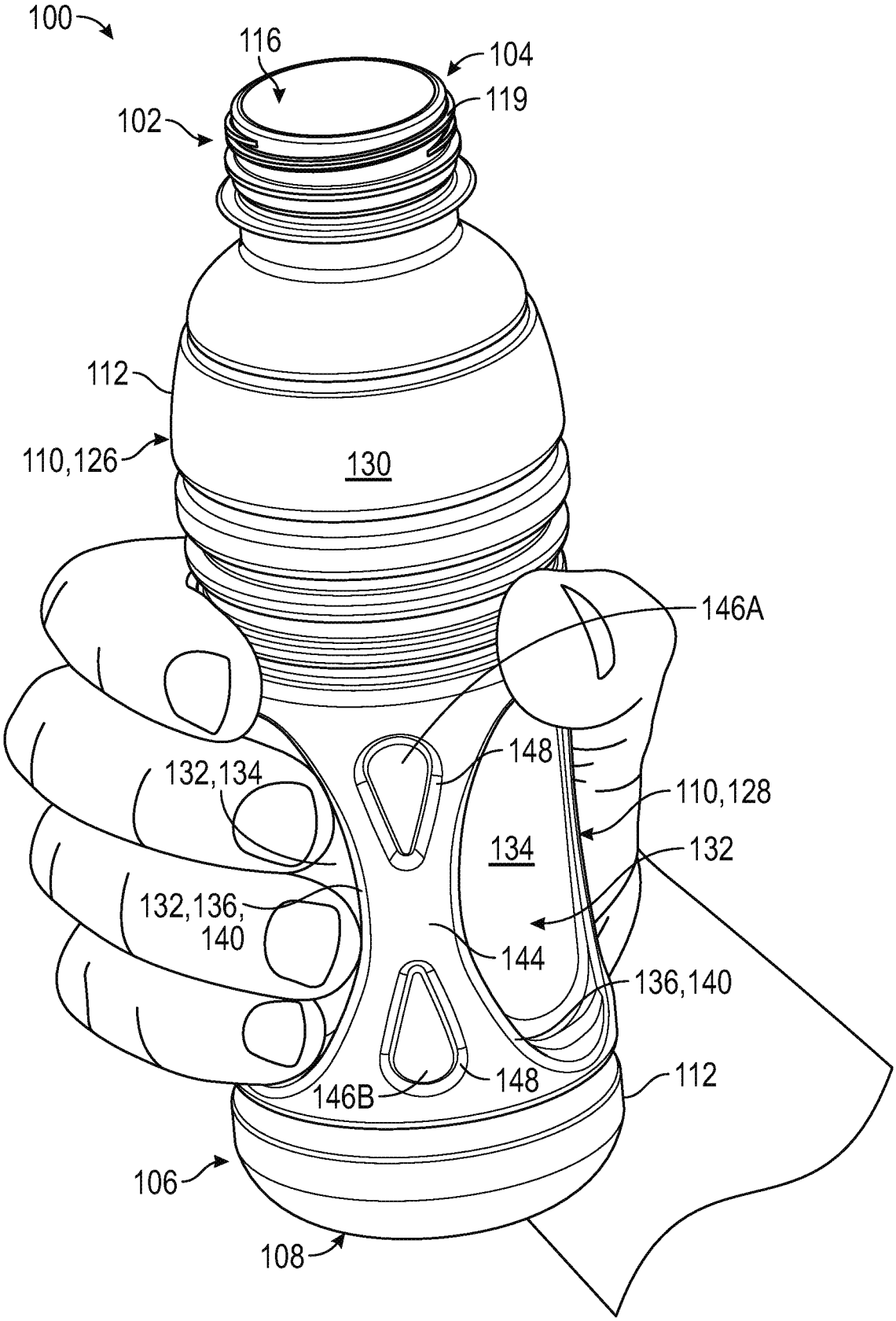
FIG. 8 displays a pictorial view of the hot-fill container of FIG. 1 being grasped by the hand of a user.

Together, the hourglass-shaped columns 144 and stiffeners 146A and 146B improve the rigidity and structural strength of the hot-fill container 100 to better resist or withstand pressure differentials across the container's wall 112. Also, as seen in FIG. 8, the hourglass-shaped columns 144 and curvilinear parts 140 of the edge portions 136 of the vacuum absorption sections 132 generally conform to the lengths of many users' middle, ring, and pinky fingers. More particularly, the curvilinear parts 140 of the edge portions 136 of the vacuum absorption sections 132 provide a stop against which the fingertips of such fingers engage while the users' index finger and thumb wrap around and grasp the container 100 at or near the intersection of the container's bulbous and label portions 126, 128. Additionally, the panel portions 134 of the vacuum absorption sections 132 provide a surface for engagement by the pulp of a user's fingers. Such capability to ergonometrically engage with a user's hand renders the hot-fill container 100 more comfortable to grasp and hold securely.

By virtue of the arrangement of the vacuum absorption sections 132 with the curvilinear part 140 of each section's edge portion 136 being angularly adjacent to the curvilinear part 140 of another section's edge portion 136, the linear part 138 of the edge portion 136 of each vacuum absorption section 132 is angularly adjacent about the central longitudinal axis 114 and parallel to the linear part 138 of the edge portion 136 of another vacuum absorption section 132 (and parallel to the central longitudinal axis 114). In such arrangement and as seen in FIGS. 4 and 5, the container's wall 112 extends between the linear parts 138 of the edge portions 136 of respective angularly adjacent vacuum absorption sections 132 and forms respective rectangular-shaped columns 150 therebetween. The rectangular-shaped columns 150 provide structural strength and rigidity to the container 100, and bear the majority of the load created during rotation or pivoting of the angularly adjacent sections' panel portions 134 about the linear parts 138 of their respective edge portions 136.

Figure 9:
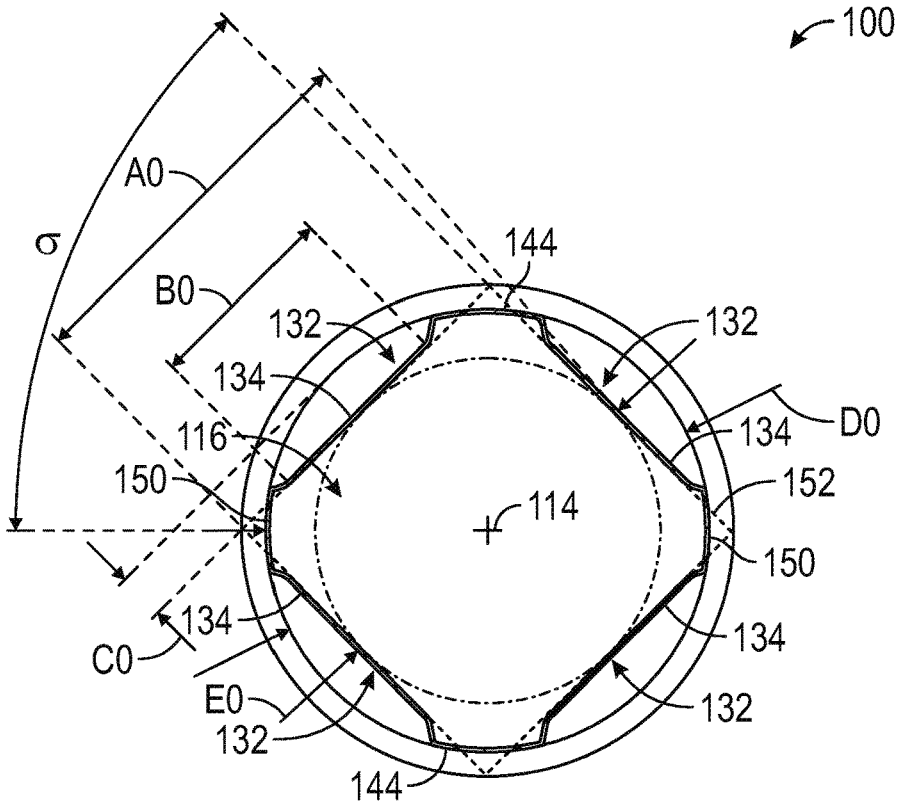
FIG. 9 displays a cross-sectional view of the hot-fill container of FIG. 2, taken along section line 9-9, in a non-deformed state.
Figure 10:
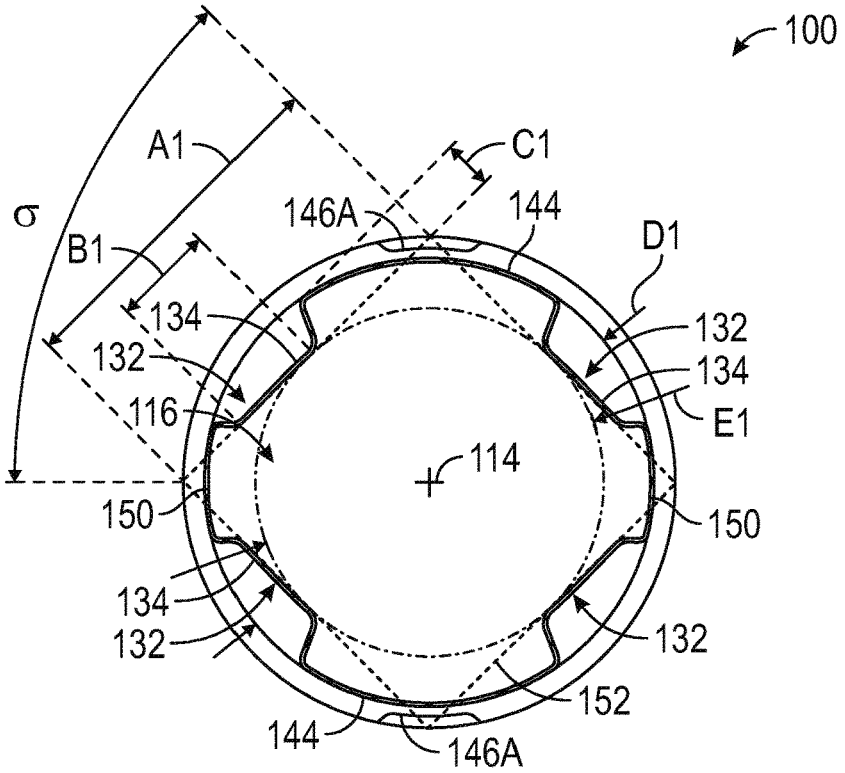
FIG. 10 displays a cross-sectional view of the hot-fill container of FIG. 2, taken along section line 10-10, in a non-deformed state.
Figure 11:
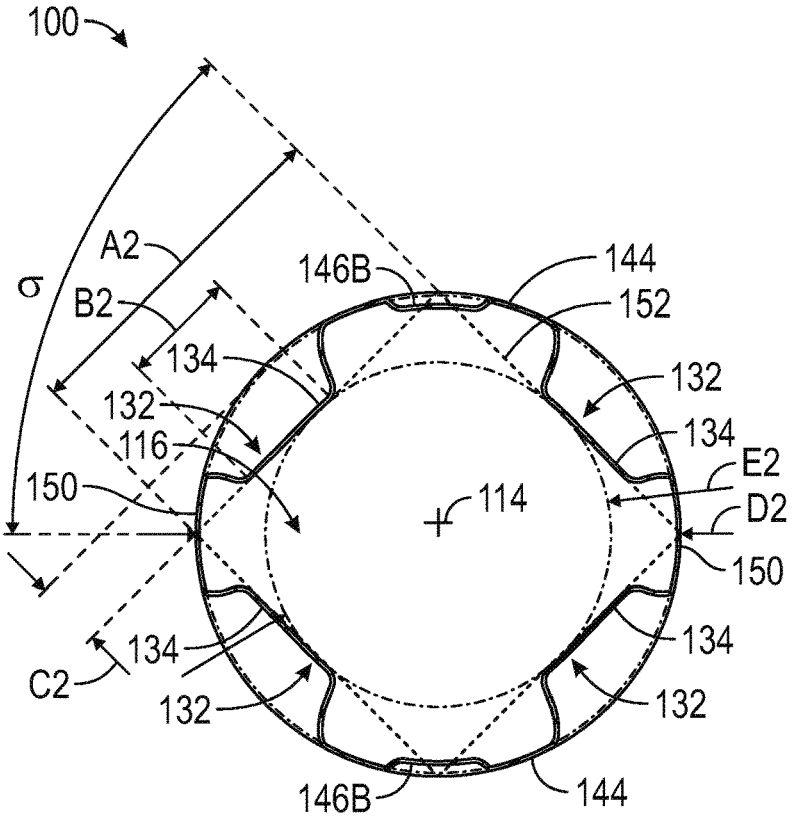
FIG. 11 displays a cross-sectional view of the hot-fill container of FIG. 2, taken along section line 11-11, in a non-deformed state.

As briefly described above and as perhaps best seen in the cross-sectional view of the container 100 in FIG. 9, the vacuum absorption sections 132 are positioned at respective angular locations about the container's central longitudinal axis 114. The hourglass-shaped columns 144 and rectangular-shaped columns 150 are also visible in FIG. 9 at their respective angular locations about the container's central longitudinal axis 114 and between angularly adjacent vacuum absorption sections 132. Notably, the panel portions 134 of the vacuum absorption sections 132 are also visible in FIG. 9 and their arrangement causes the container's wall 112 in their vicinity to substantially form the walls of a polygon 152 perpendicular to the container's central longitudinal axis 114. When viewed in top plan view, the polygon 152 appears to be inscribed in the otherwise circular periphery of the container 100. The arrangement of the panel portions 134 also causes the container's cavity 116 in their vicinity to have a corresponding substantially polygonal cross-sectional shape perpendicular to the container's central longitudinal axis 114.

According to the example embodiment, the container 100 comprises four (4) vacuum absorption sections 132 having the same size and shape and that are arranged at angular locations about the central longitudinal axis 114 ninety degrees (90°) apart. Due to such arrangement and as seen in FIG. 9, the container's wall 112 substantially forms a polygon 152 corresponding to a square having sides of a length, A0, and rotated at an angle, σ, about the container's central longitudinal axis 114 and relative to a transverse axis extending perpendicular to the central longitudinal axis 114 and through the centers of the rectangular-shaped columns 150. With the container 100 of the example embodiment having four (4) vacuum absorption sections 132, angle σ has a measure of forty-five degrees (45°).

In the vicinity of the vacuum absorption sections 132 and as described briefly above, the container's wall 112 has an hourglass or concave shape. The hourglass or concave shape results from the container wall's outer surface 130 having a radius, "R" (see FIG. 3). In accordance with the example embodiment, radius R is related to the vertical distance L between the top and bottom of the vacuum absorption sections 132 and has a measure equal to at least 4.75*L.

Referring now to FIGS. 2 and 9-11, the container's wall 112 has outside diameters, "D0", "D1", and "D2". Outside diameter D0 is located at a vertical location midway between the top and bottom of the container's vacuum absorption sections 132. Outside diameter D1 is located at a vertical location near the top of the container's vacuum absorption sections 132. Outside diameter D2 is located at a vertical location near the bottom of the container's vacuum absorption sections 132. The vertical distance between the locations of diameters D1 and D2 is referred to herein as "L", with the vertical distance between the locations of diameters D0 and D1 being L/2 and the vertical distance between the locations of diameters D0 and D2 also being L/2. According to the example embodiment described herein, diameter D1 is related to diameter D0 and has a measure equal to (1−1/50)*D0. Similarly, diameter D2 is related to diameter D0 and has a measure equal to (1−1/10) *D0.

At the respective locations of the above described outside diameters, the panel portion 134 of each vacuum absorption section 132 has a width, B0, B1 or B2, and a respective depth, C0, C1 or C2. Thus, at the vertical location of diameter D0, the panel portion 132 of the vacuum absorption section 132 has a width B0 and a depth C0. Similarly, at the vertical locations of diameters D1 and D2, the panel portions 134 of the vacuum absorption sections 132 have respective widths B1, B2 and respective depths C1, C2. Generally, the widths B0, B1, B2 of the panel portions 134 are related to the respective side lengths A0, A1, A2 of the polygon 152 formed by the panel portions 134 and have a measure between a minimum value of zero and a maximum value sufficiently less than the respective lengths A0, A1, A2. Particular values of widths B0, B1, B2 are selected such that the hourglass-shaped and rectangular-shaped columns 144, 150 provide the container 100 with sufficient strength and rigidity, while allowing inward deflection or deformation of the panel portions 134 sufficient to provide up to at least a three percent (3%) reduction in the container's volume during hot-filling. The depths C0, C1, C2 of the panel portions 134 correspond to the respective radial distances between the diameters D0, D1, D2 of the container wall's outer surface 130 and the diameters E0, E1, E2 of circles inscribed within the polygons 152 formed by the panel portions 134. Thus, the depths C0, C1, C2 have measures between a minimum value of zero and maximum values that are respectively proportional to the diameters D0, D1, D2 of the container wall's outer surface 130. Particular values of the depths C0, C1, C2 are selected to make the container 100 more easily gripped and held by a user, while permitting up to at least a three percent (3%) reduction in the container's volume during hot-filling.

It should be appreciated and understood that while the hot-fill container 100 described herein includes four (4) vacuum absorption sections 132, two (2) hourglass-shaped columns 144, two (2) rectangular-shaped columns 150, and a wall 112 having a square-shaped cross-section near the vertical midpoint of the vacuum absorption sections 132, the hot-fill container 100 may comprise a greater or lesser number of vacuum absorption panels 132 in other example embodiments and, hence, (i) a greater or lesser number of hourglass-shaped columns 144 and rectangular-shaped columns 150, and (ii) a wall 112 having a generally polygonal-shaped cross-section with a greater or lesser number of sides. Additionally, the hot-fill container 100 described herein includes vacuum absorption sections 132 having an edge portion 136 with a particular shape and panel portion 134 having a specific face area, but in other example embodiments, the vacuum absorption sections 132 may have a different size, shape, and/or face area. By varying the number of vacuum absorption sections 132 and their size, shape and area, the number of hourglass-shaped columns 144, the number of rectangular-shaped columns 150, and the shape and size of the wall's polygonal-shaped cross-section, the hot-fill container's resistance to internal pressure and uncontrolled deformation may be adapted or adjusted for particular hot-fill applications.

Whereas the present invention has been described in detail above primarily with respect to an example embodiment thereof, it should be appreciated that variations and modifications might be effected within the spirit and scope of the present invention.

What is claimed is:

1. A hot-fill container, comprising:

a finish adapted to receive a closure;

a base portion adapted to rest on a surface, said base portion and said finish defining a central longitudinal axis extending therethrough;

a body portion extending about said central longitudinal axis and intermediate said finish and said base portion, said body portion defining a cavity therein and having a plurality of vacuum absorption sections peripherally-located and protruding inwardly into said cavity, each of the plurality of vacuum absorption sections defining a planar panel portion vertically extending between a top of a respective vacuum absorption section and a bottom of the respective vacuum absorption section with an inner or outer surface of the panel portion defining a straight line in a horizontal direction at each location of the panel portion along the central longitudinal axis, at least one vacuum absorption section of said plurality of vacuum absorption sections having a shape corresponding to the English alphabet capital letter "D" with a linear part of the at least one vacuum absorption section oriented parallel to the central longitudinal axis;

a plurality of vertically oriented columns, each interposed between a respective pair of the plurality of vacuum absorptions sections and each having an upper end and a lower end;

wherein each of the vertically oriented columns is concave such that a distance between the central longitudinal axis and a middle of each column is less than a distance between the central longitudinal axis and the upper end of each column and is less than a distance between the central longitudinal axis and the lower end of each column; and wherein at each location along the central longitudinal axis, each inner or outer surface of each panel portion of said plurality of vacuum absorption sections is arranged to form a respective side of a polygon and wherein each of said plurality of vacuum absorption sections inwardly flex relative to the plurality of vertically oriented columns to form an arcuate shape when a vacuum is formed within the body portion.

2. The hot-fill container of claim 1, wherein said polygon comprises a square.

3. The hot-fill container of claim 1, wherein the at least one vacuum absorption section of said plurality of vacuum absorption sections has an edge portion configured to cause deformation of the at least one vacuum absorption section in a non-uniform manner.

4. The hot-fill container of claim 3, wherein said edge portion of the at least one vacuum absorption section includes the linear part.

5. The hot-fill container of claim 4, wherein planar panel portion near the linear part can deform inward toward said central longitudinal axis to a lesser extent than a central part of the planar panel portion.

6. The hot-fill container of claim 5, wherein said planar panel portion is adapted to rotate about said linear part of said edge portion of at least one vacuum absorption section.

7. The hot-fill container of claim 1, wherein said vacuum absorption sections are positioned between said base portion and said finish in a part of said body portion intended for grasping by a user.

8. The hot-fill container of claim 7, wherein said periphery of said body portion in a vicinity of said part of said body portion has a concave shape when viewed in elevation.

* * * * *